United States Patent [19]

Harper et al.

[11] Patent Number: 4,733,519

[45] Date of Patent: Mar. 29, 1988

[54] METHOD AND SYSTEM FOR FORMING FLOPPY DISK ENVELOPES

[75] Inventors: Bruce Harper, San Jose; Horace N. Kemp, Walnut Creek, both of Calif.

[73] Assignee: Xidex Corporation, Santa Clara, Calif.

[21] Appl. No.: 911,187

[22] Filed: Sep. 24, 1986

Related U.S. Application Data

[63] Continuation-in-part of Ser. No. 734,621, May 15, 1985, Pat. No. 4,630,427.

[51] Int. Cl.[4] ..... B65B 43/10

[52] U.S. Cl. ..... 53/456; 53/563; 53/569; 53/206; 264/339; 425/398; 425/412; 206/444; 493/251; 493/397

[58] Field of Search ..... 53/206, 218, 563, 456; 493/59, 242, 251, 355, 396, 397; 206/444; 156/257; 53/460, 209, 569; 425/398, 412; 264/339

[56] References Cited

U.S. PATENT DOCUMENTS

| | | | |
|---|---|---|---|
| 351,284 | 10/1886 | Richards | 493/242 |
| 758,672 | 5/1904 | Mayhall | 493/396 |
| 1,288,132 | 12/1918 | Nagle | 493/59 X |
| 1,525,239 | 2/1925 | Hurt | 493/396 |
| 1,685,601 | 9/1928 | Gangler | 53/206 X |
| 3,039,372 | 6/1962 | Le Bomard | 493/396 |
| 3,457,696 | 7/1969 | Berkley | 53/206 X |
| 4,447,218 | 5/1984 | Bertsch | 493/251 |
| 4,601,689 | 7/1986 | Finkle | 493/397 X |

*Primary Examiner*—John Sipos
*Attorney, Agent, or Firm*—Townsend and Townsend

[57] ABSTRACT

A method and system are provided for forming floppy disk envelopes. Envelope blanks are manipulated while attached to a continuous web of envelope material to facilitate handling and alignment of the blanks. Initially, fold lines are impressed into the envelope blanks to define the precise dimensions of the envelope. Envelope flaps are then partially folded to define a receptacle into which the disk media is then inserted. The remaining flaps are then folded and sealed, and lastly the folded envelope is detached from the continuous web. A particular apparatus for impressing the envelope blanks includes a male die, female die cavity, and mechanism for reciprocating the dies. The preferred score profile includes a pair of radii joined by a hinge section.

7 Claims, 40 Drawing Figures

METHOD AND SYSTEM FOR FORMING FLOPPY DISK ENVELOPES

This application is a continuation-in-part of application Ser. No. 734,621, filed on May 15, 1985 now U.S. Pat. No. 4,630,427.

BACKGROUND OF THE INVENTION

1. Field of the Invention

The present invention relates generally to machines and methods for forming and sealing envelopes, and more particularly to a machine for folding and inserting disks into floppy disk envelopes.

2. Description of the Prior Art

Envelopes used for encasing floppy disks are typically formed from a plastic film material having a nonwoven fabric liner for protecting the disk media. Heretofore, such envelopes have been folded from pre-cut envelope blanks which are transported individually among various folding and sealing stations on one or more folding machines. Frequently, a first folding apparatus is provided for transversely folding the envelope blank in half and sealing two flaps along the sides, leaving an open end opposite the transverse fold. The partially folded envelope is then taken to a second apparatus where the disk media is inserted and the end envelope flap folded and sealed.

The manipulation of single pre-cut envelope blanks presents a number of problems. The blanks must be advanced sequentially among various folding, disk insertion, and sealing stations, usually requiring complex systems of grippers and suction devices. Moreover, intermachine transfers are most often accomplished manually, requiring labor and often slowing down the folding process. The most serious drawback with the prior art folding machines, however, has been the difficulty in properly aligning the envelope blanks so that the dimensions of the resulting envelopes are precisely controlled.

Because the envelope holds the disk in place while the disk is being read, it is important that the dimensions of the jacket be maintained within very close tolerances. It is also critical that the folds be made accurately in order to assure that the folded envelope remains absolutely flat after the folds have been sealed. The task of forming these envelopes is further complicated when envelope holes are pre-cut envelope blanks. The holes in such pre-cut envelope blanks must be accurately aligned after folding is complete. Any misalignment of the envelope blank might render the final folded product useless.

Because of these requirements, complex aligning systems have been provided in prior art machines to assure that the envelope blank is properly positioned at each folding station. Most commonly, prior art machines utilize one or more flat mandrels for holding the envelope blank while it is folded in half and while the side flaps are sealed. The mandrel acts as a form and the jacket is folded around the mandrel. While this approach is generally workable, any slight misalignment of the equipment will result in misshaped envelopes. Moreover, the mandrels are frequently used to transport the partially folded envelope blank to a gluing or heat sealing station, thus preventing insertion of disk media during the envelope folding operation.

In view of the above, it would be desirable to develop novel methods and systems for forming floppy disk envelopes in a manner which assures proper alignment of fold lines in the final product. It would be particularly desirable if such methods and systems allowed for insertion of the disk media into the envelope during the forming process and complete sealing of the envelope before the formed product was discharged from the machine.

SUMMARY OF THE INVENTION

The present invention provides a method and system suitable for forming floppy disk envelopes while the envelopes are present on a continuous roll or web of envelope material. As the web is advanced among a plurality of folding and sealing stations, the envelopes are folded from partially-cut blanks which are formed in the web. The blanks, however, remain secured to the web through precisely located attachment points which allow the complete folding of the envelope without detachment of the blank from the web. After the folding of the envelope is complete, the attachment points are severed and the folded envelopes are removed from the web.

Although particularly suitable for forming envelopes while attached to a continuous web of material, the present invention is also suitable for forming discrete envelope jacket blanks, as described in more detail hereinbelow.

For both continuous webs and discrete jacket blanks, folding is accomplished by impressing the envelope material with four orthogonal fold lines which define the final configuration of the jacket. The impressing of all four lines is performed by a single pair of mated dies which assure that the fold lines are properly located relative to each other on the jacket. Minor misalignments which may occur during folding will have no effect on the location of the folds which are defined solely by the fold lines. Such accuracy is in contrast to the prior art where the alignment of the mandrel at each station affects the location of the fold.

In addition to providing accurate alignment, the fold lines may also define the thickness of the envelope and the interior clearance for the disk media. By scoring or molding fold lines having particular cross-sectional profiles, the dimensions of the folded envelope jacket may be controlled to very close tolerances. In contrast, folding the envelope over a mandrel provides much less control over the thickness and interior clearance of the folded jacket.

The fold lines are impressed into the envelope material either by scoring with blade dies or by molding with contoured dies. It is presently preferred to mold the fold lines using contoured dies since the heated molding process produces a thinned hinge section in the plastic jacket material which facilitates the final folding operation. Moreover, the molding process relieves stress in the fold lines which might otherwise cause deformation, e.g., arching and bowing, of the folded envelope. The use of blade dies for scoring, however, will also be useful so long as the remaining folding operations are performed in a manner consistent with the nature of the fold line.

In the preferred embodiment, the fold lines are molded by a pair of heated dies which impart a profile characterized by a thinned hinge section having an arcuate section on each side. The fold line profile has a W-shaped cross-section, resulting in the partial folding of each jacket by the molding operation. In particular, the flaps of the jacket are folded upward at about 90° resulting in a nest or receptacle for receiving the disk media prior to folding and sealing. Such disk insertion is made possible by the elimination of the mandrel used by prior art folding systems.

The method and system of the present invention are also useful for fabricating partially-folded jackets which are detached and transferred to a conventional end folder for disk insertion and sealing.

By retaining the envelope blanks on the continuous web during folding, several advantages are realized. First, advancement of the envelope blanks is facilitated as the web may be drawn forward by its edges. Second, the need to manipulate individual envelopes is eliminated until the folded envelopes are complete and detached from the web. Finally, proper alignment of the envelope blanks is assured at all times by the advancement mechanism which engages the edges of the web through precisely located registration holes.

DESCRIPTION OF THE PREFERRED EMBODIMENT

Figure 1:
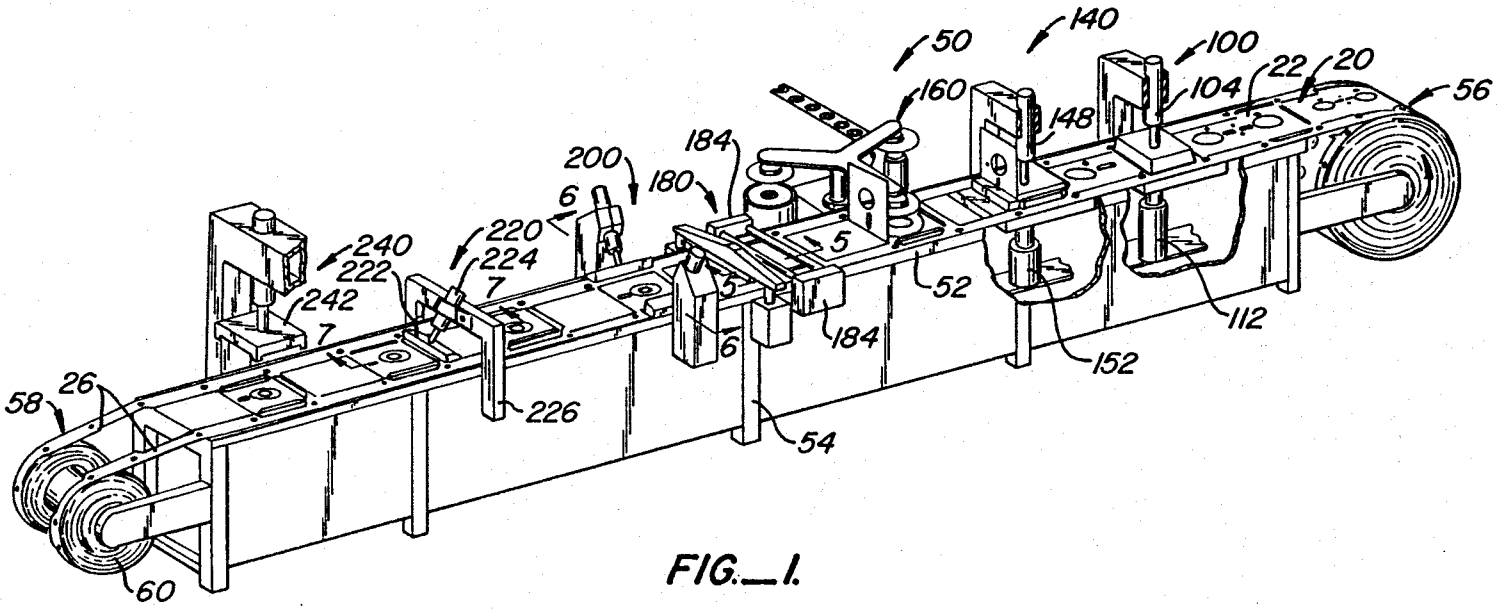
FIG. 1 is an isometric view of the envelope forming system of the present invention.

According to the present invention, a continuous web 20 (illustrated in detail in FIGS. 9 and 23) of individual envelope blanks 22 is advanced along a linear path having a plurality of work stations located therealong. Impressing of fold lines, folding, sealing, and disk insertion operations are performed at the work stations, and the final product of the operations is a ready-to-use floppy disk package.

The envelope blanks 22 (FIG. 9) are formed in the continuous web 20 by a plurality of shear lines 24 which fully penetrate the web material. The web material is a plastic, usually a thermoplastic suitable for thermal molding as described hereinafter. The preferred material is polyvinyl chloride (PVC).

The envelope blanks 22 remain attached to side trim 26 by means of six attachment points 28 for each blank 22. The attachment points are short segments (approximately 1/16") along the shear lines 24 where the web material has not been sheared. Four of the attachment points (designated **28*a*) are located at each corner of a primary flap 30 of the envelope blank 22, while the remaining two attachment points (designated 26*b*) are located along the edges of a secondary flap 32. As will be explained in detail hereinafter, the corner attachment points 28*a* remain intact during the entire folding operation of the present invention. The location of these attachment points is critical in that the secondary flap 32 may be folded over along fold line 34 (illustrated in broken line) without breaking the attachment points 28*a*, and at least two of the attachment points 28*a* will be required to hold the partially-cut envelope 22 in place. Similarly, side sealing flaps 36 may be folded along fold lines 38 and end sealing flap 40 may be folded along fold line 42 without breaking attachment points 28*a*. Attachment points 28*b*, in contrast, will be purposely broken during the preliminary folding operation, as described in detail hereinafter, when secondary flap 32** is folded upward.

Side trim 26 of the continuous web 20 includes a plurality of registration holes 44 which are utilized for advancing and aligning the web 20. Each envelope blank 22 further includes a plurality of holes necessary for functioning of the floppy disk. Of interest here are spindle holes 46 and read/write holes 48.

Referring now to FIG. 1, a forming system 50 constructed in accordance with the present invention comprises a support table 52 mounted on a freestanding frame 54. The envelope blanks 22 on continuous web 20 are fed from a spool 56 to the inlet end (to the right in FIG. 1) of the support table 52. The web 20 is advanced along the upper surface of support table 52 by a web drawing means such as an uptake spool 58 (or equivalent means, such as a grip-and-pull strip feeder or nip roll means) which collects the side trim 26 which remains after the envelope blanks 22 have been folded and removed from the continuous web 20. The web draw means 58 is intermittently driven to incrementally translate the web 20 so that the envelopes are successively advanced from station to station.

To assure proper alignment of the web at each station, reciprocatable alignment pins 64 (see FIGS. 2–5 and 8) are provided in the table 52. The pins 64 are driven by a lever 66, cam (not illustrated), or equivalent means for extending and retracting the pins through openings 68 in table 52. While the web 20 is advanced, the pins 64 remain retracted in the recess formed by openings 68 so that there is no interference. When the web 20 is fully advanced to the next position, however, levers 66 are actuated (by means not illustrated) to raise the pins 64. The upper ends of pins 64 are tapered and thus act to precisely align the envelope blank 22 at the work station.

As the continuous web is advanced along the support table 52, a series of operations are performed on the partially-cut individual envelope blanks 22 in order to fold the blanks, insert the disk media, and seal the folded envelopes along their edges. The first station illustrated at 100 (FIGS. 1 and 2) is the scoring station where a plurality of score lines are simultaneously inscribed along the fold lines 34, 38 and 42 illustrated in FIGS. 2 and 9.

Figure 2:
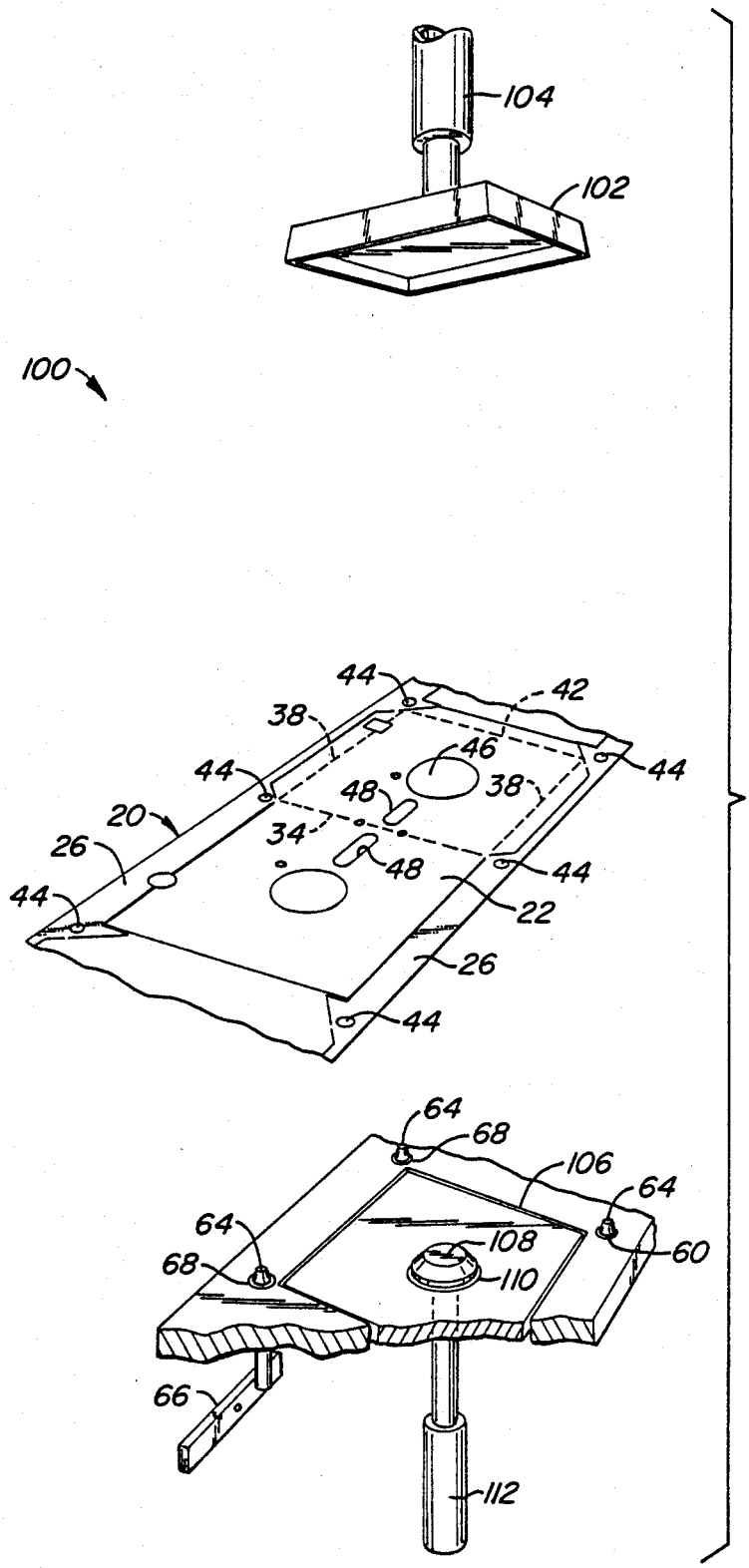
FIG. 2 is an exploded view of an impressing mechanism useful with the forming system of the present invention.

Referring in particular to FIG. 2, an impressing station 100 includes a score blade die 102 which is mounted to vertically reciprocate in ram 104. The score blade die 102 mates with line cavities 106 located in the upper surface of table 52. Both the score blade die 102 and the line cavities 106 are precisely dimensioned to inscribe fold lines 34, 38 and 42 when the envelope blank 22 is positioned at impressing station 100. An opening 110 is formed in the support table 52 to accomodate an aligning plug 108 mounted on stroking ram 112. When elevated, plug 108 engages spindle hole 46 in blank 22 to insure proper alignment of the blank during the scoring operation. Such alignment is in addition to the operation of the alignment posts 64 described hereinbefore. Optionally, an additional alignment plug (not illustrated) may be provided to engage read/write hole(s) 48.

After the aligning plug 108 has engaged the spindle hole 44 of envelope blank 22, the score blade die 102 will be lowered to press the envelope blank against line cavities 106 formed in the upper face of table 52. Conveniently, the score blade die 102 will be heated to facilitate forming the folding scores in the plastic web material.

As just described, the fold lines 34, 38 and 42 are precisely imparted to the envelope blank. While the folding operation will be completed at one or more subsequent stations, the lines along which the folds will form have been fixed at the scoring station 100. Thus, even if the jacket becomes slightly misaligned at the later folding stations, the accuracy of the folds and dimensions of the final jacket will not be affected.

In addition to a scoring operation as just described, other techniques for simultaneously impressing fold lines in the envelope blank could also be employed. For example, a rolling die could be employed with a mating die cavity in a conventional manner. A preferred technique employing molding dies is described in detail hereinafter.

A wide variety of fold profiles are suitable for use on the envelope blanks 22 of the present invention. A number of these score profiles are illustrated in FIGS. 10 through 16. These illustrations are shown in pairs, with the A illustration showing the score profile prior to folding and the B illustration showing the profile subsequent to folding. The score profile illustrated in FIGS. 10A and 10B may be imparted by cold embossing with three "V" notches 118 of 30° to a depth ranging from approximately 50 to 90% of the material thickness. When folded, the "V" notch closes to form a butted joint with folding of approximately 180°. A fixed clearance "C" is provided to allow for rotation of the disk media in the folded jacket.

Figure 11A:
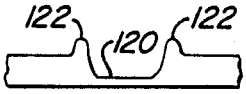
Figure 10B:
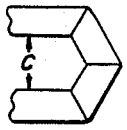
Figure 11B:
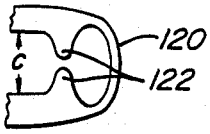

The fold profile of FIGS. 11A and 11B will be formed by thermally molding the web material to define a thin section 120 which allows easy folding. Mounds 22 which are formed around the thin section 120 will meet when the material is folded to provide a minimum clearance "C" between the two folded faces which allows for rotation of the disk media in the folded jacket.

Figure 12A:
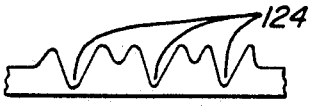
Figure 12B:
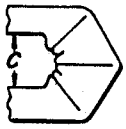

Referring to FIGS. 12A and 12B, "V" notches 124 (similar to notches 118 illustrated in FIGS. 10A and 10B) may be formed by thermal molding to provide a clearance "C", as described previously. Thermal molding of the notches is a benefit in that it helps relieve stress in the fold area and increases the area of the mating surfaces.

Figure 13A:
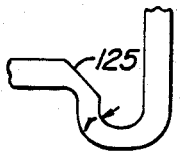
Figure 13B:
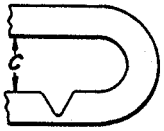

A thermally molded edge may also be formed as illustrated in FIGS. 13A and 13B. The web material is hot molded by mating dies to form the profile illustrated in FIG. 13A. The resulting fold is illustrated in FIG. 13B. The radius "r" in the U-shaped section of the profile defines the clearance "C" in the completed fold (FIG. 13B). The beveled edge 125 acts as a hinge when the envelope is eventually folded into its final configuration.

Figure 14A:
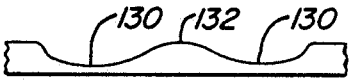
Figure 14B:
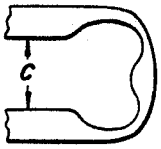

FIGS. 14A and 14B illustrate a fold profile which is formed by thermally molding two recessed areas 130 along the fold line. Section 132 between the recesses 130 defines a clearance "C" between the folded faces after folding.

Figure 15A:
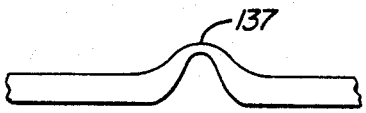
Figure 15B:
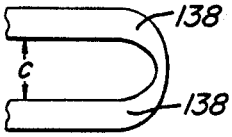

The fold line of FIGS. 15A and 15B may be formed by cold or thermal molding. The thinned section 137 defining fold line allows the fold to be accomplished with a thicker, molded radius 138 on each side, defining clearance "C" between the folded faces.

Figure 16A:
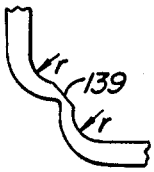
Figure 16B:
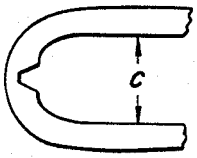

The fold lines of FIGS. 16A and 16B are formed by hot molding in a manner which is described in much greater detail hereinafter. The radii "r" together determine the final clearance "C" after the flaps are folded over hinge region 139.

The fold profiles of FIGS. 13, 15, and 16 are preferred since the radius portions of the score lines define the thickness of the floppy disk envelope, while the hinge portion precisely define the fold line. In particular, the fold line profile of FIGS. 16A and 16B is preferred for the reasons set forth more fully hereinbelow.

Figure 3:
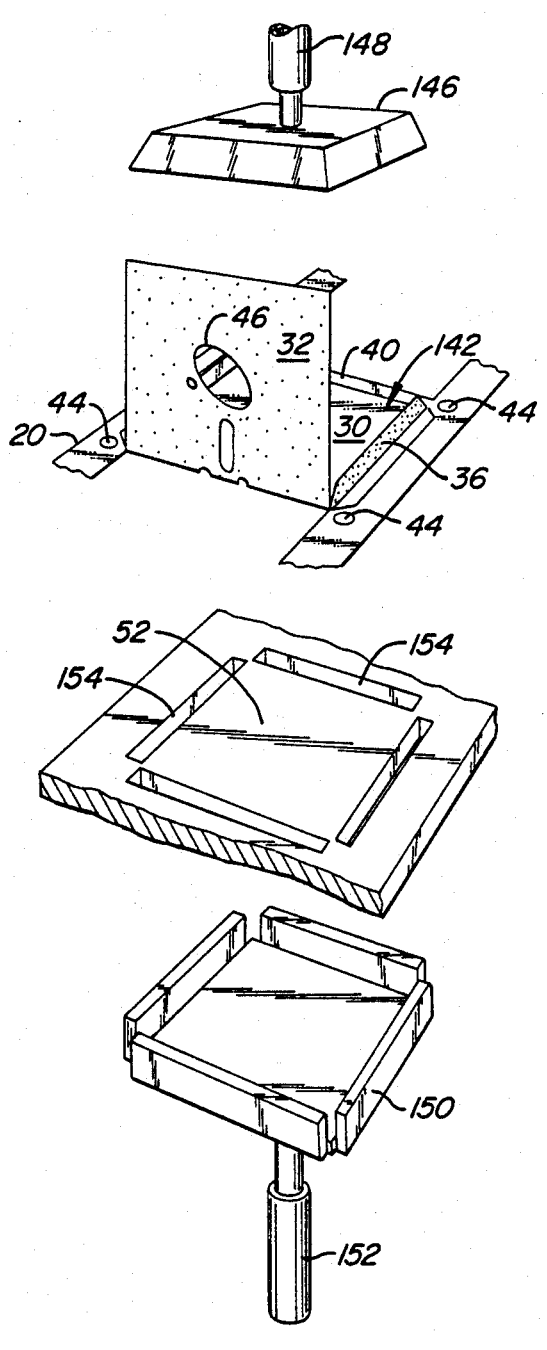
FIG. 3 is an exploded view of the preliminary folding station of the forming system of the present invention.
Figure 9:
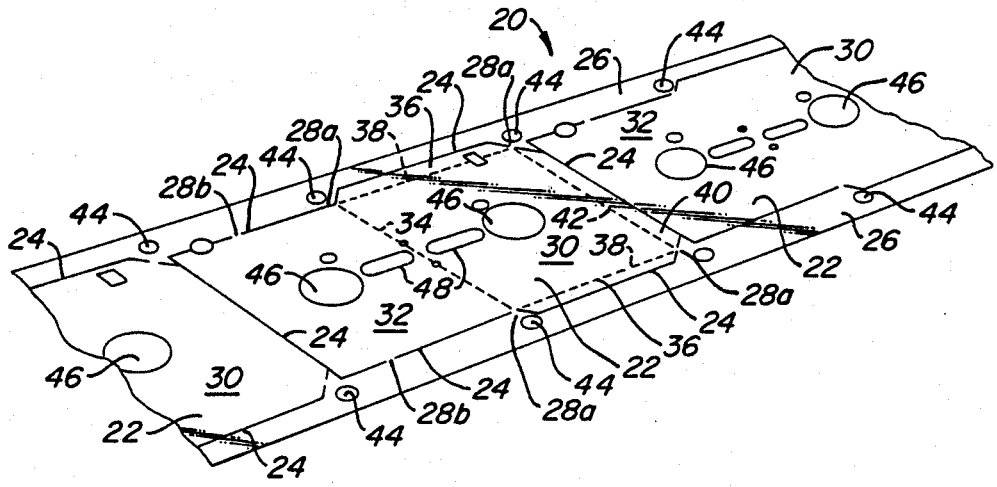
FIG. 9 illustrates a portion of the continuous web which includes the individual envelope blanks.
Figure 10A:
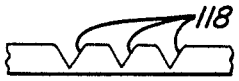
FIGS. 10–16 illustrate different score profiles which may be inscribed in the envelopes at the scoring station to facilitate subsequent folding.

Referring now to FIGS. 1 and 3, the preliminary folding station 140 will be described. The first folding station 140 imparts an approximately 90° fold to each of the secondary flap 32, side flaps 36, and end flap 40. The folds are made along fold lines 34, 38, and 42, as illustrated in FIG. 9. The folded flaps 32, 36 and 40 form a receptacle or cavity 142 in the form of a shallow, open box having the primary flap 30 as its base. The receptacle 142 receives disk media prior to complete folding of the envelope 22, as will be described hereinafter.

The first folding station 140 as described in FIG. 3 comprises a clamping mandrel 146 which is reciprocatably mounted on a ram 148. The ram 148 can lower the clamping mandrel 146 until it engages the upper surface of support table 52. In this way, the primary flap 30 of envelope blank 22 may be held in place as folding blades 150 are raised by ram 152. The folding blades 150 project through clearance slots 154 in the support table 52.

Because of the fold lines (which were formed in the envelope blank 22 at scoring station 100), the clamping mandrel 146 does not define the fold lines which are formed in the envelope. Instead, the clamping mandrel 146 is somewhat smaller than the primary flap 30, while the folding blades 150 are spaced slightly outward from the fold lines. In this way, the folds are formed precisely along the previously impressed fold lines as the folding shears 150 are raised.

In some instances, it will be desirable to combine the impressing station 100 and preliminary folding station 140 into a single station where the fold lines 34, 38 and 42, are impressed and the initial 90° completed. This is particularly true when the score profiles illustrated in FIGS. 13 and 16 are utilized. The hot molding inherently accomplishes the first fold during the impressing operation.

Figure 4:
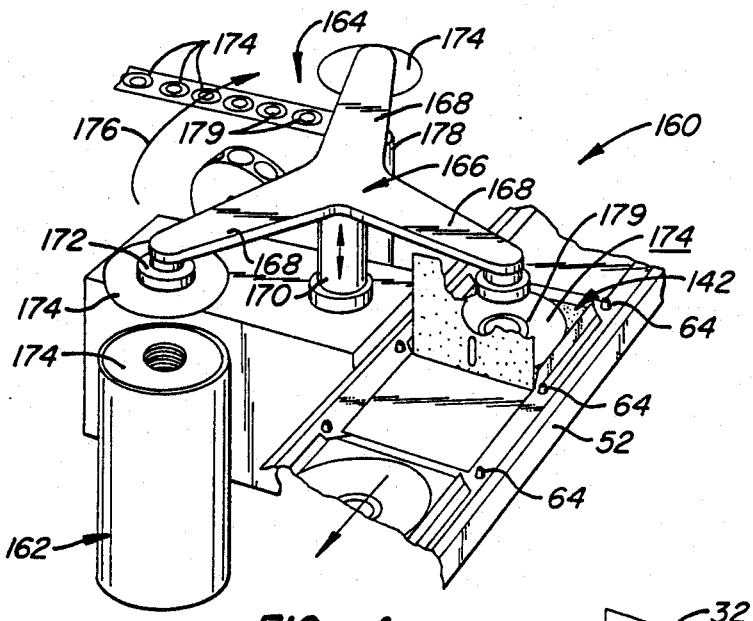
FIG. 4 is a schematic view of the disk insertion station of the forming system of the present invention, including apparatus for application of hub rings to individual disks.

The partially folded envelope blanks 22 are advanced from primary folding station 140 to disk insertion station 160 illustrated in FIGS. 1 and 4. The disk insertion station 160 includes a disk supply stack 162 and hub and ring supply assembly 164, and transfer arm assembly 166. The transfer arm assembly 166 includes three radial transfer arms 168 which are mounted on a reciprocatable shaft 170. Each arm includes a disk manipulator 172 at its outer radial end. The disk manipulator is able to selectively attach and detach individual disks 174 by means of a vacuum pick-up. Thus, an arm 168 is able to pick up a single disk 174 from the disk supply bin 162 by lowering the disk manipulator 172 to contact the disk 174, and thereafter raising the disk manipulator to remove a single disk from the stack 162. After securing and elevating the disk 174, the transfer arm assembly 166 is rotated clockwise (arrow 176) until the disk is at the hub ring supply assembly 164. There, hub ring attachment mechanism 178 will apply a hub ring 179 around the spindle hole of the disk. The transfer arm assembly 166 is then further rotated in a clockwise direction until the disk is located above cavity 142 of the partially folded envelope 22 which has arrived at the insertion station 160. The transfer arm assembly 166 is again lowered and the disk 174 is detached from the disk manipulator 172 and deposited in the cavity 142 of the envelope 22.

Figure 5A:
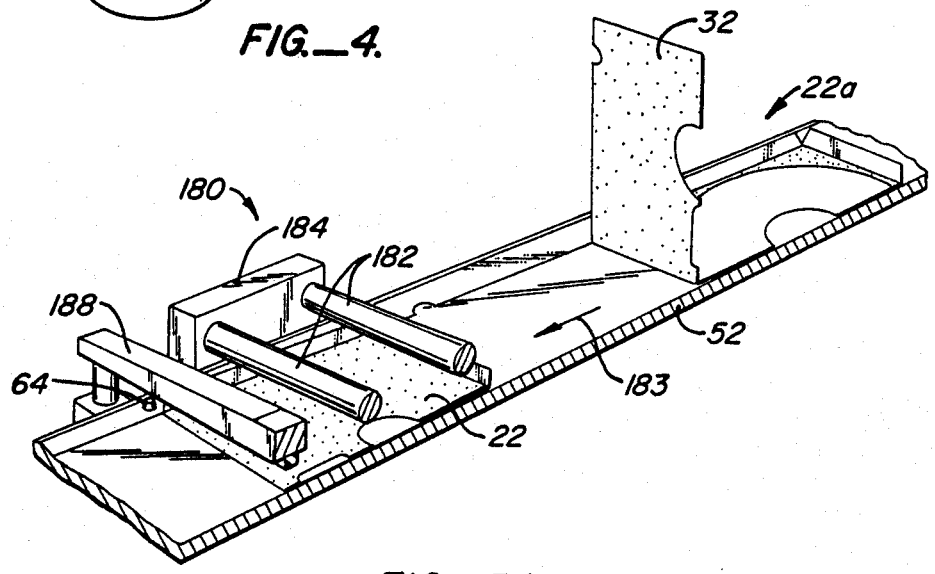
FIGS. 5A–5C schematically illustrate the operation of the transverse folding station of the forming system of the present invention.
Figure 5B:
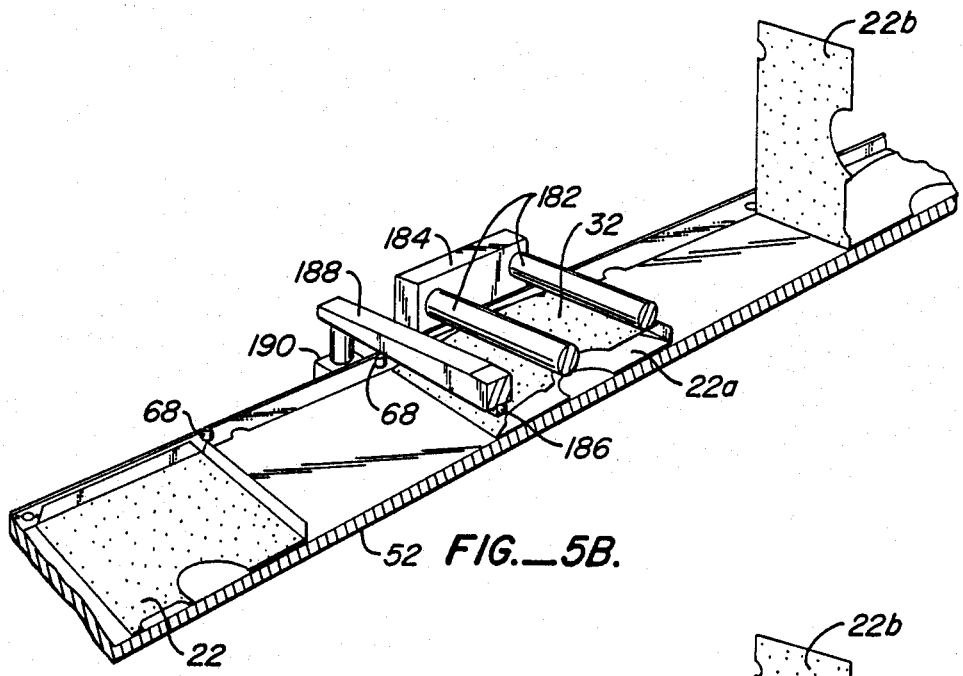
Figure 5C:
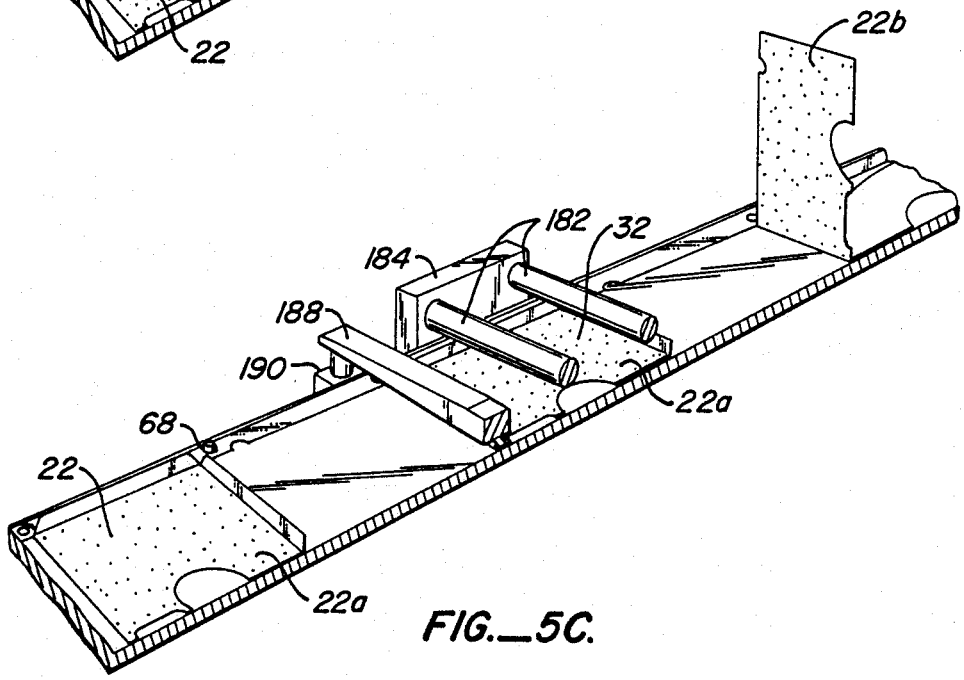

After disk insertion, arm 168 is raised, and the partially folded envelope blank 22 is advanced to transverse folding station 180. Referring to FIGS. 1 and 5A–5C, transverse folding station 180 includes one or more of folding bars 182 which are secured at either end in support brackets 184. The support brackets 184, in turn, are mounted on opposite sides of the support table 52. The folding rods 182 are fixed in place and mounted transversely across support table 52. Thus, as a partially folded envelope 22 (FIG. 5A) is advanced to the left (arrow 183), secondary flap 32 which is projecting upward, engages the folding rods 182. The folding rods 182 fold secondary flap 32 downward until it reaches the position shown in FIG. 5B. The advance mechanism is stopped at this position and a resilient folding bar 186 is lowered onto the fold line 34 (FIG. 9), as illustrated in FIG. 5C. Resilient folding bar 186 is mounted on a transverse support bar 188 which in turn is mounted on vertically reciprocatable rams 190 secured to either side of the support table 52.

Figure 6A:
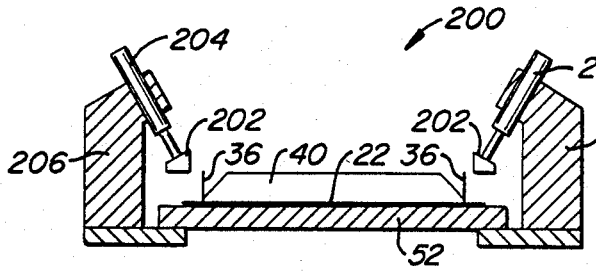
FIGS. 6A and 6B schematically illustrate the operation of the side flap folding mechanism of the forming system of the present invention.
Figure 6B:
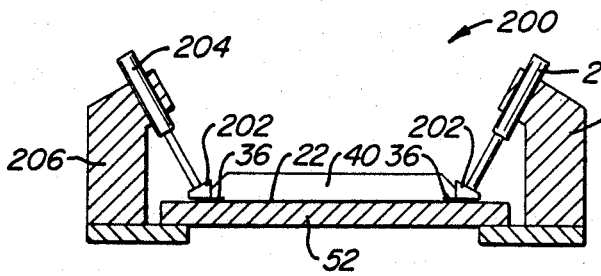

After folding the secondary flap 32, the envelope 22 is advanced to the side flap folding station 200, illustrated in FIGS. 6A and 6B. The side flap folding station includes folding bars 202 mounted on rams 204. The rams 204, in turn, are mounted on bracket assemblies 206 so that one folding bar 202 is on each side of the support table 52. The folding bars 202 are located so that they lie adjacent the upper end of side flaps 36 when the rams 204 are in their retracted position. The rams 204 are mounted at such an angle so that the folding bar 202 will engage the side flaps 36 near the middle and complete the fold of the side flap as the rams 204 are extended, as illustrated in FIGS. 6B. The folding bars 202 are then retracted and the envelope 22 is ready to be advanced to the next station.

Figure 7A:
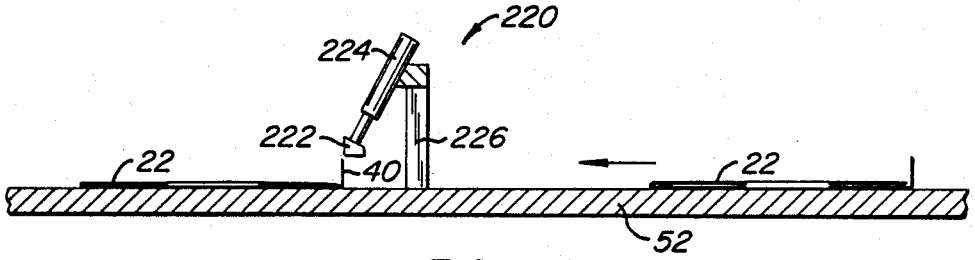
FIGS. 7A and 7B schematically illustrate the operation of the end flap folding mechanism of the forming system of the present invention.
Figure 7B:
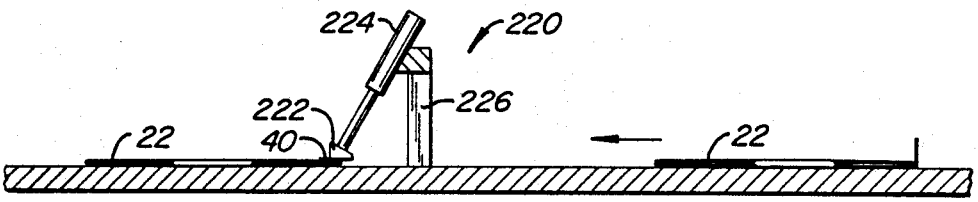

The envelopes 22 are next advanced to the end folding station 220, as illustrated in FIGS. 7A and 7B. The end folding station 220 comprises a single folding bar 222 mounted on a ram 224. The ram 224, in turn, is mounted on a support frame 226 which is attached on either side of support table 52. In this way, the ram is suspended over the center of the support table 52, and the folding bar 222 is located across the support table 52. As the envelopes 22 are advanced, they come to rest with end flap 40 lying immediately forward (to the left) of the folding bar 222, as illustrated in FIG. 7A. The ram 224 is then extended, and the folding bar 222 moves downward to fold the end flap 40 over, as illustrated in FIG. 7B. The folding of the envelope is then complete.

Frequently, it will be desirable to incorporate side flap folding station 200 and end flap folding station 220 into a single station. The stations 200 and 220 have been shown separately in order to facilitate description and illustration.

In addition to the work stations described thus far, it will sometimes be necessary to add a sealing station. Sealing of the folded envelopes may be accomplished by providing pressure sensitive adhesives on the flaps 36 and 40, in which case the flaps will be sealed when the folding is accomplished at stations 200 and 220 (requiring no additional work station). Sealing may also be accomplished by heat-staking which will require additional heat-staking apparatus. Such heat staking apparatus is well known in the art, and may be installed in a separate station following end folding station 220. Alternatively, the sealing station may be mounted within the end folding station 220, or at a combination side flap and end flap folding and sealing station.

Figure 17:
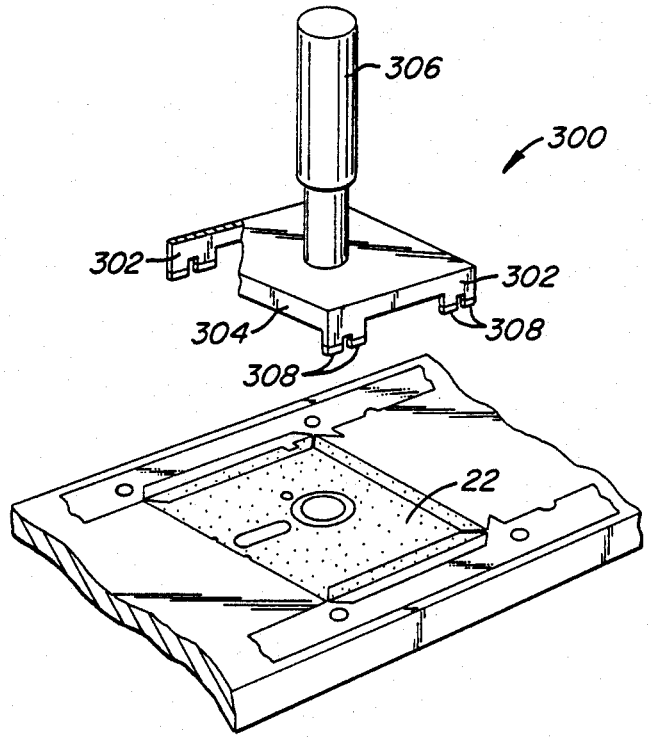
FIG. 17 is a schematic view of the heat stake station of the forming system of the present invention.

A suitable heat staking station is illustrated at 300 in FIG. 17. The heat staking station 300 includes three heat stake blades 302 (only two of which are illustrated) mounted on reciprocatable plate 304. The reciprocatable plate 304, in turn, is reciprocatably mounted on a ram 306 so that heated tips 308 on the blades 302 may be lowered into contact with a folded envelope 22 which has been advanced to a position on support table 52 directly below the plate 304. The tips 308 are electrically heated to a temperature sufficient to melt the PVC envelope material so that the flaps 34 and 36 are melted onto the underlying face of the envelope. Heat is applied for a time sufficient to melt the PVC. After melting, the heat is removed, but the reciprocatable plate is not raised until the melted areas of the envelope have cooled and hardened.

Also, it may sometimes be beneficial to provide an annealing station to relieve stress in the jacket resulting from the folding. Annealing is accomplished by clamping the jacket flat against the table 52 and applying heat to the folded edges of the jacket.

Figure 19:
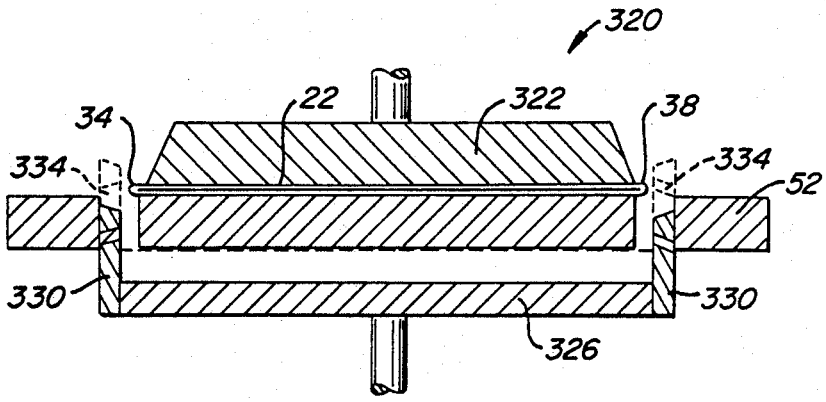
FIG. 19 is a cross-sectional view of the annealing station of the forming system of the present invention.
Figure 18:
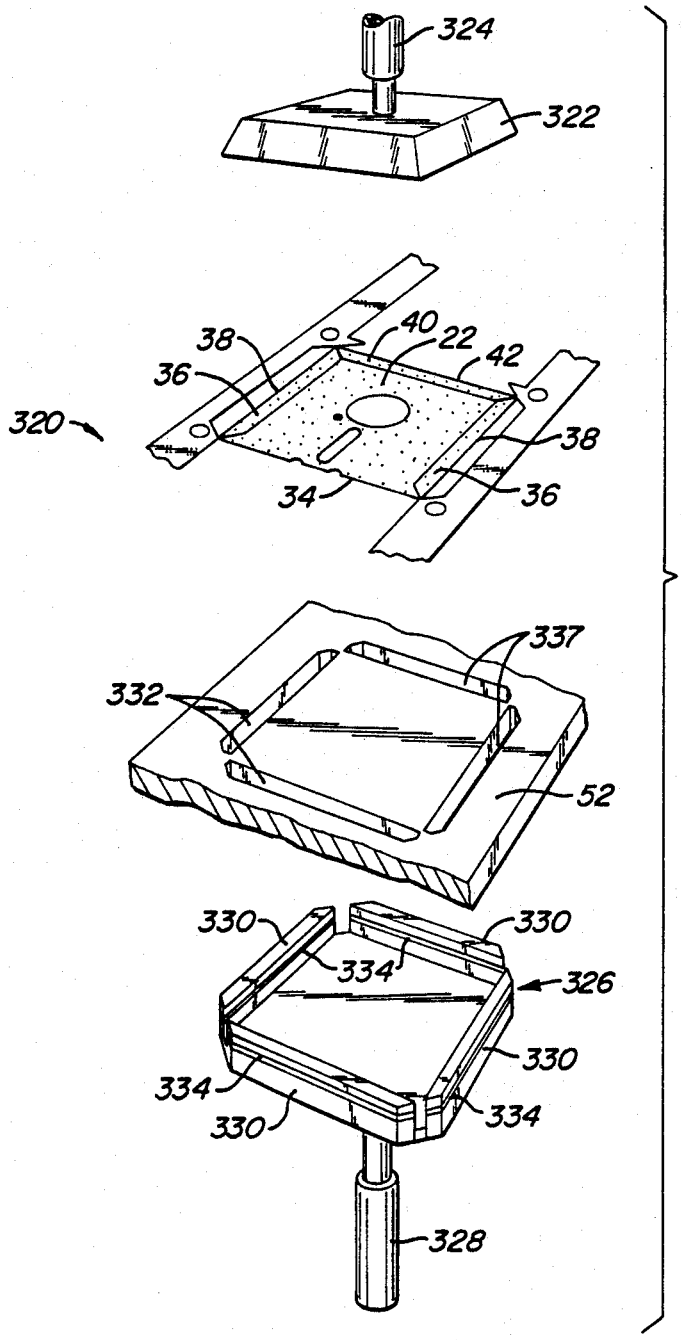
FIG. 18 is an exploded view of the annealing station of the forming system of the present invention.

A suitable annealing station is illustrated in FIGS. 18 and 19. The folded envelope 22 is advanced to annealing station 320 along support table 52. The annealing station 320 comprises a clamp member 322 which is reciprocatably mounted in ram 324 over table 52. A radiant heat member 326 is reciprocatably mounted in ram 328 beneath table 52. Radiator bars 330 are attached at the periphery of the radiant heat member 326 so that they will extend through slots 332 in Table 52 when elevated. As best illustrated in FIG. 19, radiant elements 334 located in each radiator bar 330 are positioned adjacent the fold lines 34, 38 and 42 when the member 326 is in its fully raised position (as illustrated in broken line).

To anneal a folded envelope 22, the envelope is advanced to annealing station 320 while clamp member 322 is raised and radiant heat member 326 is lowered. As soon as the envelope 22 is properly positioned, the clamp member 322 is lowered, and radiator member 32 is raised. Heat is applied through the radiant elements 334 for a time and at a temperature sufficient to relieve stress in the folds. After heat application is stopped, the envelope 22 remains clamped while the folds cool. The envelope 22 may then be advanced to the next station, typically the detachment station 240.

Figure 8:
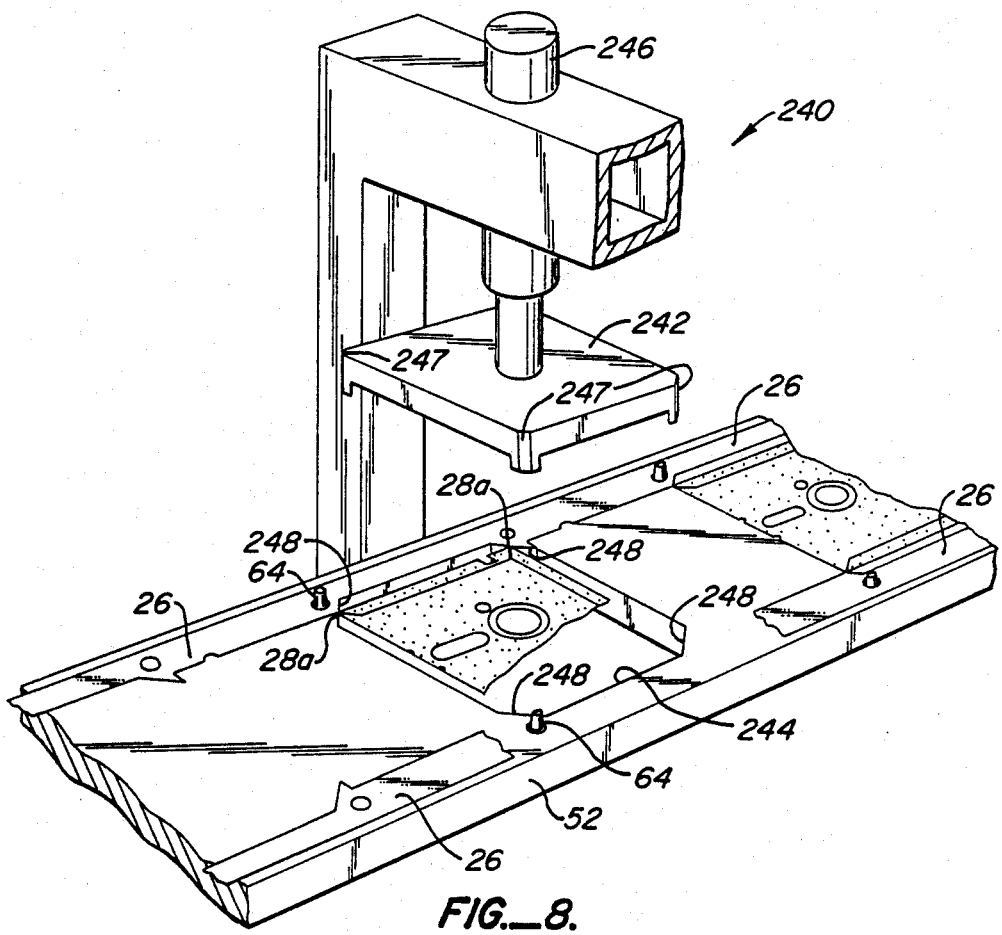
FIG. 8 is a simplified detail view illustrating the punch station of the system of the present invention.

The folded envelope is advanced from the end folding station 220 (or sealing station if employed) to detachment station 240, illustrated in FIG. 8. Detachment station 240 includes a punch member 242 which is aligned with opening 244 formed in the support table 52. The punch member 242 is mounted in a vertically acting ram 246 so that the punch member may reciprocate in and out of the receiving hole 244 formed in table 50. The four corners 247 of the punch member 242 are beveled and aligned with the four corners 248 of the opening 244, resulting in a shearing action as the punch member 242 is lowered. The punch member 242 is thus able to sever the four attachment points **28*a* which hold the folded envelope 22 onto the side trim 26. The folded envelope is thus released from the side trim and falls downward through the opening 244** where it is collected.

Referring now to FIGS. 20–29, a particular embodiment of the impressing station 100' will be described. The impressing station 100' includes a conventional die set, such as a Danly die set, including a pair of die supports 400 and 402 mounted on vertical posts 404. The lower die 402 is fixed on the posts 404 while the upper die is mounted on sleeve bearings 406 (only one of which is visible in FIG. 20) allowing the upper die support to reciprocate relative to the lower die support.

A male die member 410 is mounted on the upper die support 400 while a female die member 412 is mounted on the lower die support 402. Fluid connections 414 are provided on the male die member to supply a heating fluid to the die to assist in thermal molding, as will be described in detail hereinafter. Similar connections may also be provided on the female die member 412, although they are not illustrated in the drawings.

Figure 21:
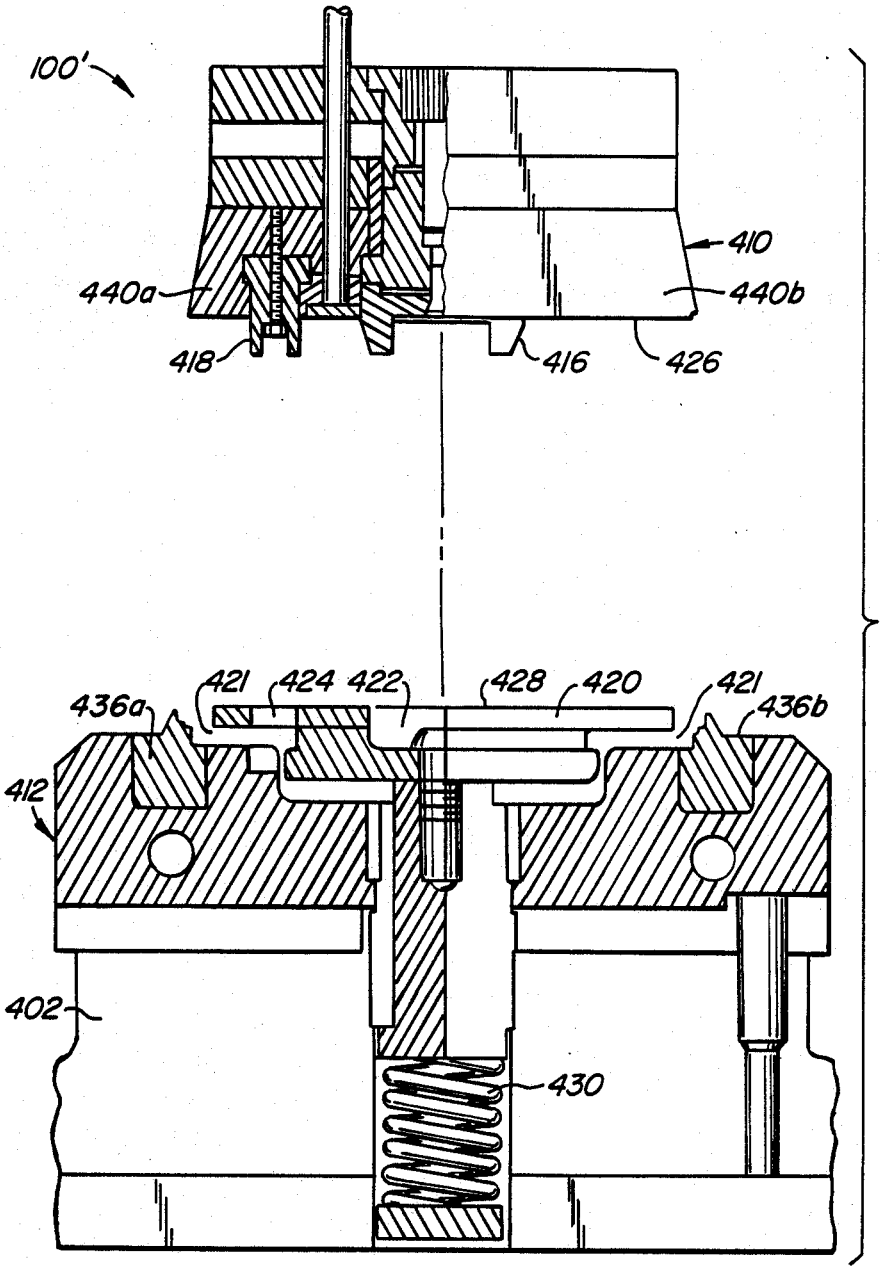
FIG. 21 is an elevational view of the molding dies of FIG. 20, with portions broken away.

Referring now in particular to FIG. 21, the male die member 410 includes a central spindle 416 which engages the spindle hole 46 (FIGS. 9 and 23) in the envelope jacket. An additional alignment pin 418 is also provided to engage the read/write hole 48 in the envelope blank 22. In this way, the envelope blank 22 will be properly aligned regardless of whether the impressing operation is performed on discrete envelope blanks or on envelope blanks which are part of a continuous web.

The female die member 412 includes a reciprocatable support plate 420 in its central portion. The reciprocatable support plate 420 includes a central cavity 422 which receives the spindle 416 of the male die member 412. Similarly, an alignment aperture 424 is provided for receiving the alignment member 418 when the male die member 410 is lowered onto the female die member 412. Thus, the envelope blank 22 will be captured in between contact surface 426 of the male die member and the upper surface 428 of the reciprocatable plate 420 of the female die member 410. Further lowering of the male die member 410 will impress the envelope blank 22 into the die cavity of the female die member 412, as will now be described in detail. The reciprocatable plate 420 is spring mounted on spring 430 so that the envelope blank will be raised back above the die cavity after the molding operation is complete.

Figure 20:
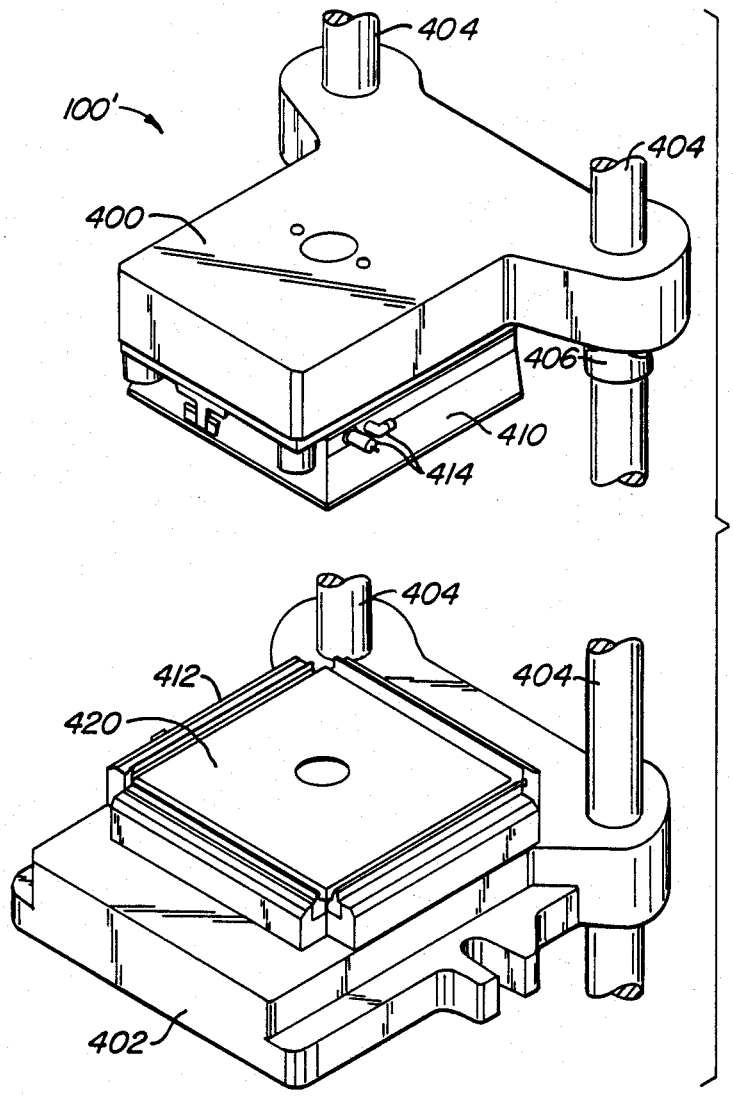
FIG. 20 is an exploded isometric view of the preferred fold line impressing mechanism of the present invention, including a pair of molding dies.

The female die cavity 421 is defined by four linear die elements 436 about the periphery of the cavity 421. The male die member 410 also includes four linear die elements 440 (only two of which are illustrated in FIGS. 20 and 21). As will be described in detail hereinafter with reference to FIGS. 26 and 27, the linear die elements 436 and 440 together define a molding cavity for impressing a desired thermal mold in the envelope blanks 22.

Figure 22:
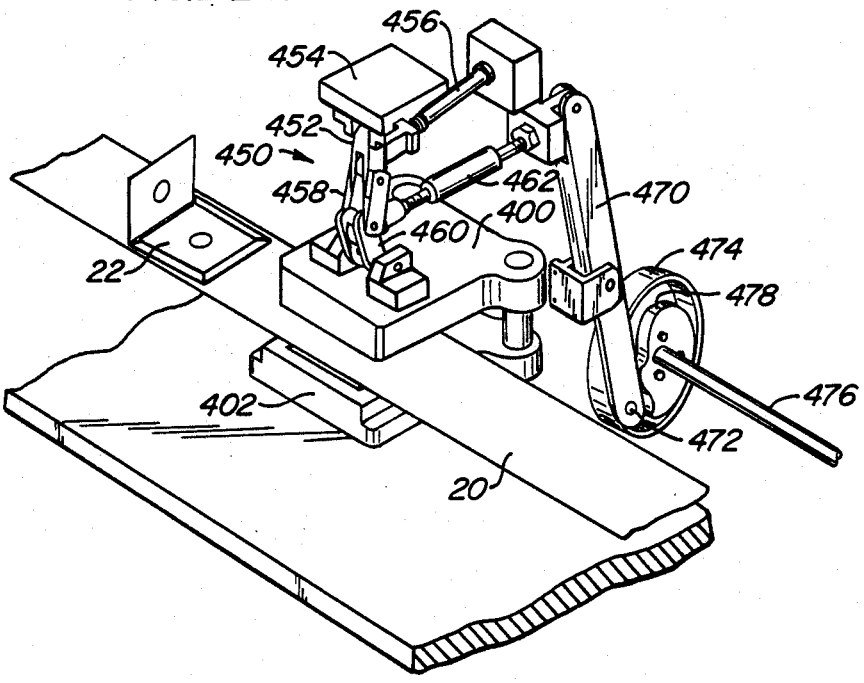
FIG. 22 illustrates the molding dies of FIG. 20 together with a reciprocation apparatus.

Referring now to FIG. 22, a mechanism for reciprocating the die supports 400 and 402 will be described. The reciprocation assembly 450 includes a first link arm 452 which is pivotally secured at its upper end to a fixed plate 454. The first link arm 452 is secured at its middle to an adjustment member 456 and at its lower end to a second link arm 458. The second link arm is pivotally secured to a third link arm 460 which in turn is pivotally secured to the upper surface of the upper die support 400. The hinge joint between the second and third link arms 458 and 460 is attached to an adjustable arm 462 which in turn is attached to a lever arm 470. The lever arm 470 is pivotally mounted near its middle and includes a cam follower 472 at its lower end. The cam follower rides in an enclosed cam member 474 which in turn is rotated on an axle 476. A cam surface 478 in the cam member 474 is selected to translate the upper end of the lever arm 470 back and forth according to a predetermined pattern. The upper end of the lever arm 470, in turn, transmits a corresponding lateral motion to the hinged joint between the second and third link arms 458 and 460. As the upper end of the second link arm is normally fixed, the lateral reciprocation of the joint causes the vertical reciprocation of the lower end of the third link arm 460. This in turn causes the upper die support to reciprocate vertically, as desired.

This particular drive linkage for reciprocating the upper die support 400 is preferred because it provides a maximum downward force at the point of maximum extension of the link arms. This in turn, assures that adequate impression molding of the envelope blanks 22 will be provided. The precise downward travel of the linkage may be adjusted by adjustment member 456.

Figure 23:
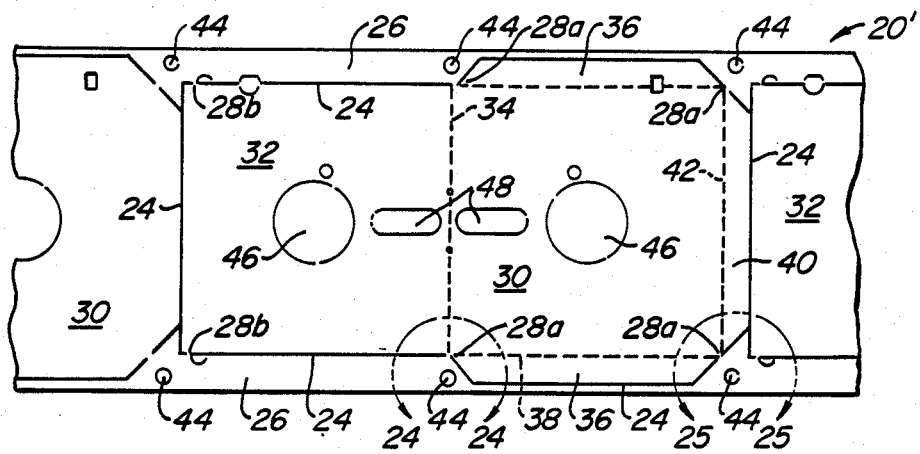
FIG. 23 illustrates a continuous web of envelope material having individual jackets partially cut therein.
Figure 24:
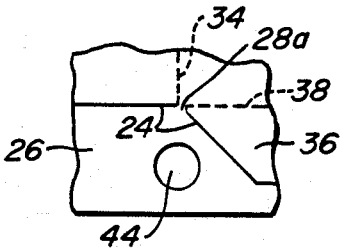
FIG. 24 is a detail view from FIG. 23, illustrating the middle attachment point between the partially cut envelope blank and the remaining side trim of the web.
Figure 25:
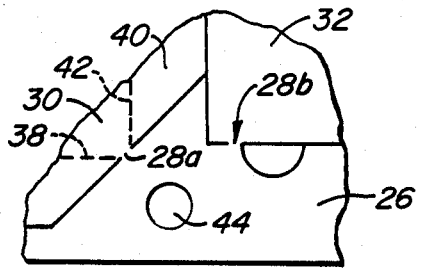
FIG. 25 is a detail view from FIG. 23, illustrating the end attachment ponts between partially cut envelope blank and the remaining side trim of the web.

Referring now to FIGS. 23–25, a preferred arrangement of fold lines on an envelope nlank 22' will be described using the same reference numerals as used with FIG. 9. The general arrangement of fold lines 24 in envelope blank 22' is identical with that illustrated in FIG. 9. The location of the attachment points and location of the fold lines relative to the attachment points, however, has been optimized to provide for precise folding of the envelopes without accidental detachment of the envelopes from the side trim strips 26. In particular, attachment points 28a securing the distal end of the primary flap 30 to the side trim strips 26 are defined by leaving a gap in the shear lines 24 as illustrated in FIG. 25. Similarly, attachment points 28a at the proximate end of the primary flap 30 are defined by leaving a gap in the shear lines 24, as illustrated in FIG. 24. The fold lines 34 and 38 are terminated on either side of the attachment point 28a so that the attachment point is not stressed. The same approach is taken with attachment points 28b holding the secondary flap 32 to the side trim 26. The termination of the shear lines 24 is accomplished by leaving small gaps in the linear die elements 36 and/or 40 in the male and female die members 410 and 412, respectively.

Figure 26:
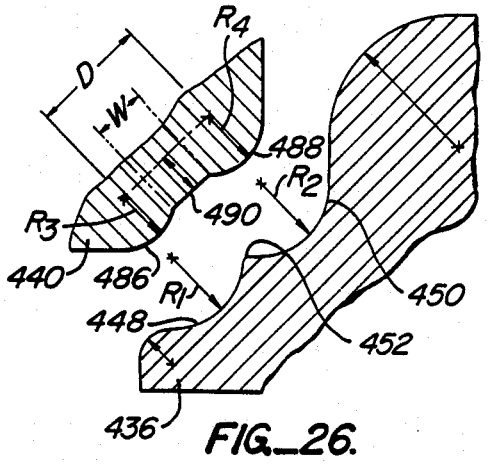
FIG. 26 illustrates the molding die surfaces for forming the fold line between the primary and secondary flap of the envelope jacket.

Referring now to FIG. 26, the preferred contours for linear die elements 436 and 440 will be described in detail. The female linear die element 436 includes a pair of concave arcuate surfaces 448 and 450 meeting along an elongate ridge 452. The radius $R_1$ of the first arcuate surface 48 will usually be about equal to the radius $R_2$ of the second arcuate section, although not necessary.

The male linear die element 440 includes a pair of convex arcuate surfaces 486 and 488 which mate with the concave arcuate surfaces 480 and 482 in the female die element 436. A generally flat connecting section 490 joins the two arcuate surfaces 486 and 488 and mates with the elongate ridge 452 in female die element 440. The first arcuate surface 486 has a radius $R_3$, while the second arcuate surface 488 has a radius $R_4$, while the connecting section has a width W. Spacing between the center of radii for both pairs of arcuate surfaces is indicated by dimension D. The dimensions of the surfaces will vary, depending on the thickness of the envelope material, on the desired internal clearance in the folded envelope, and on which of the fold lines is being impressed. The fold lines 34 between the primary and secondary flaps 30 and 32 will have a smaller clearance than that defined by the fold lines 38 and 42 which must fold over the secondary flap 32. While the dimensions may vary, suitable dimensions for conventional disk media having a thickness of 0.003 inches and envelope material having a thickness of about 0.009 inches are set forth in Table 1.

TABLE 1

| Dimension* | Fold Line 34 | | Fold Lines 38, 42 | |
|---|---|---|---|---|
| (inches) | Range | Preferred | Range | Preferred |
| $R_1$ | 0.025–0.035 | 0.0309 | 0.03–0.04 | 0.0360 |
| $R_2$ | 0.025–0.035 | 0.0309 | 0.03–0.04 | 0.0360 |
| $R_3$ | 0.018–0.025 | 0.0204 | 0.02–0.03 | 0.0255 |
| $R_4$ | 0.018–0.025 | 0.0204 | 0.02–0.03 | 0.0255 |
| W | 0.010–0.020 | 0.014 | 0.015–0.20 | 0.018 |
| D | 0.045–0.055 | 0.0479 | 0.05–0.06 | 0.0557 |

*Dimensions referencing FIG. 26.

Figure 27:
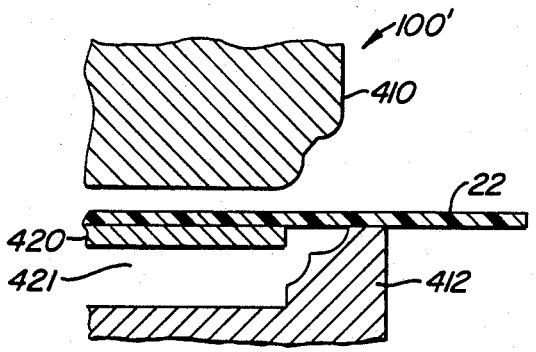
FIGS. 27 and 28 schematically illustrate the molding of a fold profile and hinge section in accordance with the method of the present invention.
Figure 28:
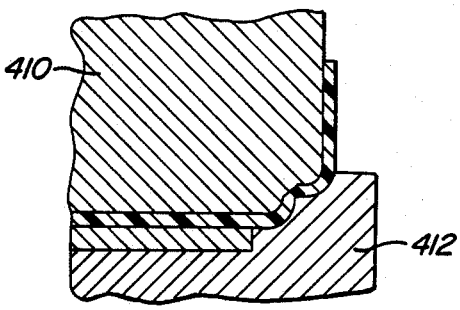

Referring now to FIGS. 27 and 28, when the envelope blank 22' first enters the impressing station 100', it is supported above the female die cavity 421 by the reciprocating plate 420 (FIG. 27). The male die member 410 is then lowered, as illustrated in FIG. 28, compressing the envelope material within the die cavity formed between the lower surface of the male die 410 and the upper surface of the female die 412. Reciprocating plate 420 is lowered in cavity 421 and the fold lines are impressed into a W-shaped cross-section forming an approximately 90° fold along the fold line. The envelope blank leaving the impressing station 100' is thus ready for disk insertion, as described previously.

The temperature, pressure, and time of the molding operation should be controlled to partially stress relieve the fold lines without melting the plastic material so that it collapses. For PVC material having a thickness of about 0.009 inches, the mold dies 410 and 412 should be heated to about 200° F. and brought together with a total force in the range from about 4000 to 6000 lbs. The total contact time will be in the range from about 0.5 to 1.5 seconds, usually about 1 second. The parameters, of course, may be varied if a different jacket material is employed.

Figure 29:
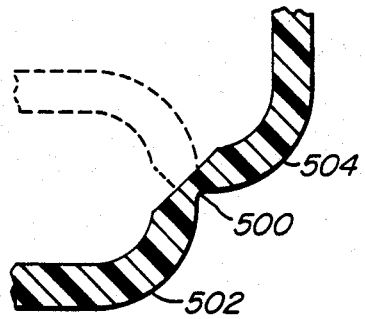
FIG. 29 is a detail view illustrating the resulting fold profile imparted by the apparatus and method of the present invention.

FIG. 29 illustrates the resulting fold profile in detail. A coined hinge 500 is formed by ridge 452 and surface 490, while molded radii 502 and 504 are formed by arcuate surfaces 448 and 486, and 450 and 488, respectively. When folded over (as illustrated in broken line) the fold assumes an almost perfect half-circle free from internal stress which can cause jacket deformation, particularly if the jacket is exposed to wide temperature variations.

Although the foregoing invention has been described in some detail by way of illustration and example for purposes of clarity of understanding, it will be obvious that certain changes and modifications may be practiced within the scope of the appended claims.

What is claimed is:

1. A method for forming a floppy disk envelope, said method comprising:

immobilizing an envelope blank composed of a thermoplastic having a primary flap joined to a secondary flap along a first edge and to three sealing flaps along the other three edges;

simultaneously impressing four orthogonal fold lines in the blank along the four edges of the primary flap, with a reciprocating die mechanism having profile of a pair of adjacent arcuate sections to form. said fold lines having a profile including a pair of arcuate sections having first and second radii in the range from about 0.02 to 0.04 inches respectively and joined by a thinned hinge section;

simultaneously folding the secondary and sealing flaps upward along the fold lines to define a receptacle for receiving a disk media;

folding the secondary flap downward onto the disk media, whereby the primary and secondary flaps are spaced apart by a distance equal to the sum of the radii to provide sufficient internal clearance for the disk media; and folding and sealing the sealing flaps onto the primary flap.

2. A method as in claim 1, wherein impressing the four orthogonal fold lines comprises reciprocating a pair of mating dies which impart the profile.

3. A method as in claim 1, wherein the envelope blank is composed of a thermoplastic material and mating dies are heated to enhance formation of the fold profile.

4. A method as in claim 2, wherein the mating dies fold the secondary and sealing flaps upward along the fold lines as part of the impressing step.

5. A method as in claim 1, further comprising the step of annealing the fold lines after folding and sealing.

6. An apparatus for folding a floppy disk envelope blank having a rectangular primary flap joined to a secondary flap along a first edge and to three sealing flaps along the other three edges, said apparatus comprising:

means for immobilizing the envelope blank at a preselected position and orientation;

means for impessing four orthogonal fold lines in the blank and folding the secondary and sealing flaps upward at approximately a right angle to define a receptacle for receiving disk media along the four edges of the primary flap, said means comprising a male die, a female die cavity, and means for reciprocating the male and female dies, said female die comprising of a pair of concave arcuate surfaces having radii $R_1$ and $R_2$, said male die comprising of a pair of convex arcuate surfaces having radii $R_3$ and $R_4$ connected by a flat section with length W, the center of radii of both pairs of arcuate surfaces are spaced by length D, with the following dimensions, for the fold line along the first edge:

$R_1$: 0.025 to 0.035 inches;
$R_2$: 0.025 to 0.035 inches;
$R_3$: 0.018 to 0.025 inches;
$R_4$: 0.018 to 0.025 inches;
W: 0.010 to 0.020 inches; and
D: 0.045 to 0.055 inches; and for the fold lines along the other three edges:
$R_1$: 0.03 to 0.04 inches;
$R_2$: 0.03 to 0.04 inches;
$R_3$: 0.02 to 0.03 inches;
$R_4$: 0.02 to 0.03 inches;
W: 0.015 to 0.02 inches; and
D: 0.05 to 0.06 inches;

means for placing a disk media into the receptacle;

means for folding the secondary flap downward onto the disk media; and means for folding and sealing the sealing flaps onto the primary flap.

7. An apparatus for impressing score lines onto floppy disk envelope jacket blanks along four edges, said apparatus comprising:

a male die and a female die cavity, said female die comprising of a pair of concave arcuate surfaces having radii $R_1$ and $R_2$, said male die comprising of a pair of convex arcuate surfaces having radii $R_3$ and $R_4$ connected by a flat section with length W, the center of radii of both pairs of arcuate surfaces are spaced by length D, with the following dimensions for the fold line along one edge, wherein:

$R_1$ is in the range from about 0.025 to 0.035 inches;
$R_2$ is in the range from about 0.025 to 0.035 inches;
$R_3$ is in the range from about 0.018 to 0.025 inches;
$R_4$ is in the range from about 0.018 to 0.025 inches;
W is in the range from about 0.010 to 0.020 inches; and
D is in the range from about 0.045 to 0.055 inches;
and for the fold lines along the other three edges:
$R_1$ is in the range from about 0.03 to 0.04 inches;
$R_2$ is in the range from about 0.03 to 0.04 inches;
$R_3$ is in the range from about 0.02 to 0.03 inches;
$R_4$ is in the range from about 0.02 to 0.03 inches;
W is in the range from about 0.015 to 0.02 inches; and
D is in the range from about 0.05 to 0.06 inches;

wherein the male die and female die cavity together define four orthogonal fold lines having a fold profile including a pair of arcuate sections having a preselected radii joined by a hinged section;

means for reciprocating the male and female dies relative to each other; and means for feeding the floppy disk envelope blanks to a fixed location between the male and female dies so that the fold lines will be positioned along preselected fold lines on the blank.

* * * * *